US005282956A

United States Patent [19]

Weaver

[11] Patent Number: 5,282,956

[45] Date of Patent: Feb. 1, 1994

[54] METHOD FOR THE INHIBITION AND REMOVAL OF AMMONIUM CHLORIDE DEPOSITION IN HYDROCARBON PROCESSING UNITS

[75] Inventor: Carl E. Weaver, Conroe, Tex.

[73] Assignee: Betz Laboratories, Inc., Trevose, Pa.

[21] Appl. No.: 909,858

[22] Filed: Jul. 7, 1992

[51] Int. Cl.[5] ..... C10G 9/16; C23F 14/00; C07C 307/00

[52] U.S. Cl. ..... 208/48 AA; 208/47; 252/390; 252/401; 106/14.15; 203/7; 585/950

[58] Field of Search ..... 208/48 AA, 47; 252/390, 252/401; 106/14.15; 203/7; 585/950

[56] References Cited

U.S. PATENT DOCUMENTS 3,260,538 7/1966 Gardner ..... 252/390
4,793,865 12/1988 Staley et al. ..... 134/2

*Primary Examiner*—Mark L. Bell
*Assistant Examiner*—Patricia L. Hailey
*Attorney, Agent, or Firm*—Alexander D. Ricci; Gregory M. Hill

[57] ABSTRACT

A method for the inhibition and removal Of ammonium chloride deposition in hydrocarbon processing units comprising adding to the hydrocarbon liquid an amide selected from the group consisting of dimethylformamide and 1,3-dimethyl-2-thiourea.

3 Claims, No Drawings

METHOD FOR THE INHIBITION AND REMOVAL OF AMMONIUM CHLORIDE DEPOSITION IN HYDROCARBON PROCESSING UNITS

FIELD OF THE INVENTION

The present invention relates to the field of hydro carbon processing and specifically deals with the problems associated with the deposition of ammonium chloride salt crystals on metallic surfaces of the overhead equipment in elevated temperature processing units.

BACKGROUND OF THE INVENTION

A frequent source of operating problems in refining and hydrocarbon processing units is the formation of deposits throughout those units resulting in a drop in pressure, decrease in efficiency, increase in energy consumption, loss of operating time, and other well-known difficulties. These deposits include salts of ammonia, inorganic contaminants that enter the process in the feed, and deposits that develop as by-products from corrosion of the processing unit including metal sulfides, metal oxides, metal hydroxides, and other metal salts. These deposits alone or in combination with other hydrocarbon polymers and decomposition products often form deposits that are difficult to remove from the internal surfaces of the processing units.

During the processing of hydrocarbon liquids, such as crude oil, under the elevated temperature conditions of a refinery, small amounts of water emulsified or otherwise entrained in the hydrocarbon will first vaporize and then later condense on the metallic surfaces of the equipment overhead of high temperature units, such as distillation columns. This water contains acidic elements, predominantly hydrochloric acid (HCl), which will corrode the surfaces of the overhead equipment at locations where condensation occurs.

In an attempt to minimize this corrosion, hydrocarbon processors will add chemical compounds to the hydrocarbon prior to elevated temperature processing for the purpose of neutralizing the acid, e.g., HCl. The compound most frequently employed is ammonia. The ammonia will neutralize the HCl by forming ammonium chloride.

The neutralization of HCl by ammonia mitigates against the problems of corrosion but the formation of ammonium chloride causes others. The ammonium chloride, which is vaporized during elevated temperature processing, is sublimed onto the surfaces of the overhead equipment. Sublimation, as herein defined, is intended to mean that the ammonium chloride passes directly from the vapor state to its solid crystalline form, bypassing its liquid phase. Crystalline ammonium chloride builds up on these surfaces resulting in the operational problems previously discussed.

It is an object of the present invention to inhibit the growth of ammonium chloride deposits on the surfaces of the overhead equipment in a hydrocarbon refinery. The aforementioned problems are overcome by the present invention which discloses a method for the complete removal and/or prevention of the formation of deposits of ammonium chloride.

DETAILED DESCRIPTION OF THE INVENTION

The present invention comprises a method for treating ammonium chloride deposition on the internal surfaces of an elevated temperature hydrocarbon processing unit which consists of adding to the hydrocarbon liquid an effective amount of an amide having the following structure:

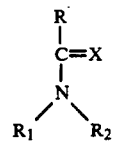

wherein x+0, s; R=H, $NR_1R_2$, alkyl; $R_1$=H, alkyl and $R_2=R_1$, but not both H.

Those amides contemplated as being covered by the present invention are selected from the group consisting of dimethylform amide (DMF) and 1,3-dimethyl-2-thiourea (DMTU).

The amides of the present invention may be utilized at a petroleum refinery experiencing ammonium chloride deposition problems. They may be added to the hydrocarbon liquid at any convenient location prior to the location or locations where elevated temperature processing of the hydrocarbon occurs and sublimation of ammonium chloride subsequently results. Suitable locations are within the crude unit distillation tower, into the trays within these towers, heat exchangers, receiving tanks, pump-rounds, overhead lines, reflux lines, connecting lines and the like.

The amount of the amide of the present invention that is required to achieve the desired objective of inhibiting or removing ammonium chloride deposition will vary and will depend upon the amount of ammonium chloride present in the hydrocarbon liquid prior to elevated temperature processing. The preferred method of determining the correct amount of amide that must be added is by measuring the amount of ammonium chloride present in the hydrocarbon liquid. This may be accomplished by one of many well known means of analysis such as the phenate method for the determination of nitrogen, #417C from the Standard Methods for the Examination of Water and Wastewater, 16th Ed., pp 382–383, incorporated herein by reference. Thereafter, the moles of ammonium chloride present are determined by conventional calculation methods.

The amount of the amide necessary to achieve the objectives of the invention is a factor of the moles of ammonium chloride present in the hydrocarbon. This amount may be in the range of 1–10,000 ppm, by weight, based on the hydrocarbon liquid. Depending on the distinct design characteristics or operating conditions of the hydrocarbon processing unit to be treated, the amount of the amide required falls within the range of 1 to 10 moles per mole of ammonium chloride.

The amide compound may be added to the hydrocarbon liquid either continuously or intermittently, as the processing unit design or operating conditions dictate. The compound may be added neat, or it may be dissolved as necessary in a suitable solvent.

EXAMPLE

A conventional laboratory reflux apparatus was employed to establish the efficacy of the present invention. The test consisted of heating to reflux for 4 hours 0.0025 mol (0.1334g) of ammonium chloride in 100 ml of heavy aromatic naphtha (HAN) either with the treatment according to the invention, DMF or DMTU, or without (blank). After the reflux period, the sublimed ammonium chloride was washed from the internal surface of the condenser with water. The amount of ammonium chloride sublimed on these surfaces was then determined by the phenate method for the determination of nitrogen, as defined above.

The amount of sublimed ammonium chloride according to the aforementioned test procedure is shown in Table I, below.

TABLE I

Amount of Ammonium Chloride Sublimed Expressed as a Percentage of The Initial Ammonium Chloride

| Treatment | Amount | Treatment: Ammonium Chloride (mol:mol) | % Ammonium Chloride Sublimed |
|---|---|---|---|
| Blank (mean) | — | — | 61+/−10* |
| DMTU | 14.6 ppm | 1:1 | 6,10 |
| DMF | 14.6 | 1.1:1 | 4,5,20 |

*average of 10 runs.

The amount of ammonium chloride deposited on the internal surfaces of the reflux apparatus without treatment was approximately 61% of the total ammonium chloride added to the test apparatus prior to refluxing. The treatments with DMF and DMTU reduced by almost 90% the amount of sublimed ammonium chloride.

Comparative tests were conducted utilizing other amides as the ammonium chloride treatment compound. These results are presented in Table II.

TABLE II

| Treatment | Treatment: Ammonium Chloride (mol:mol) | % Ammonium chloride Sublimed |
|---|---|---|
| Formamide | 1.1:1 | 34,28 |
| Diphenylthiourea | 1:1 | 52 |
| Urea | 1.2:1 | 48,77 |

It is apparent that not all amides possess the desired ability to reduce or inhibit sublimed ammonium chloride deposits. DMF and DMTU consistently exhibit this desired objective.

What I claim is:

1. A method for inhibiting the deposition of ammonium chloride on the metallic surfaces of the overhead equipment of a refinery which processes hydrocarbon liquids comprising adding to the hydrocarbon liquid an ammonium chloride deposition inhibiting amount of an amide selected from the group consisting of dimethylformamide and 1,3-dimethyl-2-thiourea.

2. The method of claim 1 wherein from 1 to 10 moles of the amide is added to the hydrocarbon liquid per mole of ammonium chloride.

3. The method of claim 1 wherein ammonia has been added to the hydrocarbon liquid.

* * * * *